US007066217B2

(12) United States Patent
Ludwig

(10) Patent No.: US 7,066,217 B2
(45) Date of Patent: Jun. 27, 2006

(54) METHOD FOR FILLING A CONTAINER WITH A LIQUID OR POURABLE SUBSTANCE

(75) Inventor: Detlef Ludwig, Duisburg (DE)

(73) Assignee: Krohne Messtechnik GmbH & Co. KG, Duisburg (DE)

( * ) Notice: Subject to any disclaimer, the term of this patent is extended or adjusted under 35 U.S.C. 154(b) by 151 days.

(21) Appl. No.: 10/775,265

(22) Filed: Feb. 10, 2004

(65) Prior Publication Data

US 2005/0173016 A1 Aug. 11, 2005

(30) Foreign Application Priority Data

Feb. 21, 2003 (DE) ..... 103 07 672

(51) Int. Cl.
*B65B 1/04* (2006.01)
*B65B 3/04* (2006.01)

(52) U.S. Cl. ..... 141/100; 141/83; 141/1; 141/103; 141/98

(58) Field of Classification Search ..... 141/83, 141/100, 1, 103, 198
See application file for complete search history.

(56) References Cited

U.S. PATENT DOCUMENTS

| | | | | |
|---|---|---|---|---|
| 4,559,979 | A * | 12/1985 | Koblasz et al. | 141/198 |
| 4,804,024 | A * | 2/1989 | Arnemann | 141/83 |
| 4,890,774 | A * | 1/1990 | Poore | 141/83 |
| 5,515,888 | A | 5/1996 | Graffin | |
| 5,718,268 | A * | 2/1998 | Muscara | 141/83 |
| 6,148,877 | A * | 11/2000 | Bethke | 141/83 |
| 6,334,471 | B1 * | 1/2002 | Graffin | 141/83 |
| 2003/0121561 | A1 | 7/2003 | Wagner et al. | |

FOREIGN PATENT DOCUMENTS

| | | | |
|---|---|---|---|
| DE | 69405004 | T2 | 3/1998 |
| DE | 19834900 | A | 2/2000 |
| DE | 10149473 | A | 4/2003 |
| DE | 10159272 | A1 | 6/2003 |
| DE | 19701001 | A | 7/2005 |
| EP | 0700830 | A1 | 9/1994 |

(Continued)

OTHER PUBLICATIONS

European Search Report, European Patent Office, Jun. 8, 2004.

*Primary Examiner*—Khoa D. Huynh
(74) *Attorney, Agent, or Firm*—Cesari and McKenna, LLP; John F. McKenna

(57) ABSTRACT

A method for dispensing a specific minimum amount of a liquid or pourable substance into a container to fill the container, in the course of which the amount of the dispensed substance is measured and a valve is close to terminate the filling process as soon as the amount of the dispensed substance has reached a defined final value in which the substance is dispensed into a first container in several dispensing steps. During an initial dispensing step, the filling process is interrupted by the closing of the valve so as to permit determination of the tailing of the substance that occurs during the closing of the valve, while for a subsequent dispensing step the valve is opened to resume the filling process, with the final value for terminating the subsequent dispensing step being established by factoring-in a tailing value of the substance that was determined in a preceding dispensing step during the closing of the valve. In this fashion, greater accuracy is achieved in filling the container with the substance especially upon restarting the dispensing system employed for implementing the method.

5 Claims, 2 Drawing Sheets

FOREIGN PATENT DOCUMENTS

| | | |
|---|---|---|
| JP | 06127506 | 5/1994 |
| JP | 09259272 | 9/1997 |
| JP | 10016903 | 1/1998 |
| JP | 2000282763 | 9/2000 |

* cited by examiner

METHOD FOR FILLING A CONTAINER WITH A LIQUID OR POURABLE SUBSTANCE

BACKGROUND OF THE INVENTION

1. Field of the Invention

This invention relates to a method for dispensing a defined minimum quantity of a liquid or pourable substance into a container, in the process of which the amount of the substance dispensed is measured and a valve closes to terminate the filling process as soon as the amount delivered has reached a specific final value.

In the production and distribution of liquid or pourable substances such as beverages, the filling of these substances into containers, for instance bottles, plays a significant economic role. Typically, the substance is dispensed by a large filling and packaging system such as a rotary bottling machine, for instance with 150 bottling stations that permit the simultaneous filling of 150 bottles. A rotary bottling system of that type is capable of filling up to 70,000 bottles per hour, each holding one liter of the beverage concerned. Overfilling each bottle with only 5 milliliters of beverage adds up to an error amount of 350 L per hour, 850 L per day and about 250,000 L per month. Hence, for cost reasons alone, accurately quantized dispensing of the beverage is highly desirable.

2. Background Information

In prior-art packaging systems, the filling of the containers with the substance concerned typically involves the following steps. The substance is delivered from a storage tank through a valve into a container, with the quantity of the substance delivered to the container, typically its volume or weight, being measured by means of a mass or volume flowmeter. As soon as the dispensed amount of the substance thus measured has reached a setpoint value, hereinafter referred to as the final value, the valve closes, terminating the filling process.

The closing of the valve, however, takes a finite length of time as a result of which, after the predefined setpoint value is reached, an additional amount of the substance is delivered into the container, a phenomenon referred to as tailing. Such tailing is also attributable to the fact that the valve, being a mechanical component, and the valve-controlling device activating the valve, are subject to response and dead times. As a rule, then, the amount of substance dispensed into the container exceeds the final value at which the closing of the valve is to terminate the filling process.

In prior-art packaging methodology, this problem is often addressed by measuring for each container filling the tailing amount and comparing it with the minimum amount that should be dispensed into the container. The difference between the measured actual amount and the setpoint minimum amount, constituting the tailing, is deducted from the nominal quantity in subsequent filling processes either in stepwise fashion, i.e. only by a certain percentage at a time, or by establishing a floating mean value from the tailing values of several consecutive measurements. The actual amount dispensed into the container concerned is thus reduced, approaching the targeted minimum amount over the course of several consecutive filling cycles. An immediate, complete adjustment in the second filling cycle for the tailing measured in the first cycle is not possible, given that such compensation would be subject to unstable fluctuation.

It is in particular at the time of the startup of a filling system, for instance on changeover to a new substance, or after cleaning or after being reset for a different container capacity, that the initial quantities dispensed are quite inaccurate, so that the amounts filled into the containers often exceed established tolerances. Taking for instance a large rotary bottling system with 150 bottling stations, any startup of the system can result in as many as 1,000 improperly filled and thus partly unsaleable bottles.

SUMMARY OF THE INVENTION

It is, therefore, the objective of this invention to introduce a method for filling a liquid or pourable substance into a container, offering improved dispensing accuracy especially upon startup of the decanting and packaging system used in applying this dispensing method.

According to this invention, that objective is achieved by filling the substance into a first container in several dispensing steps whereby, after a first dispensing step, the valve is closed to interrupt the filling process, allowing the determination of the tailing of the substance that occurs during the closing of the valve, followed as the next step by the opening of the valve to resume the filling process, at which juncture the final value for terminating the subsequent dispensing step is established, factoring-in the tailing of the substance as determined in a preceding dispensing step during the closing of the valve.

In other words, especially for the startup of the system used in applying this filling method, the invention provides for the dispensing of the substance into the first container not in one continuous step but in at least two discrete steps, whereby the filling of the first container is interrupted at least once by closing the valve, thus allowing the tailing to be quantified. The tailing factor determined in this fashion can already be used in the filling of the first container, allowing the final value for terminating the filling of the first container to be established in a manner as to keep the filling of that container within permissible tolerances.

It is entirely possible to apply the method according to this invention using only two mutually different dispensing steps for filling the container. However, a preferred version of the invention provides for the first dispensing step to be followed by multiple consecutive dispensing steps, involving the determination of each individual final value for terminating the respective subsequent dispensing step after factoring-in the tailing of the substance as determined in the respective preceding dispensing step during the closing of the valve. An appropriately large number of consecutive dispensing steps following the initial dispensing step permits the determination of a corresponding number of tailing values, and especially a sufficient number of tailing values whereby in any event the final value for terminating the last dispensing step for filling the container can be achieved within predefined tolerances.

In a preferred implementation of the invention, the final value for terminating the last dispensing step in filling the container is determined by compensating for the tailing of the substance determined in the preceding dispensing step during the closing of the valve in due consideration of the intended minimum substance amount. In another preferred implementation of the invention, the final value for terminating the last dispensing step in filling the container is established in consideration of the minimum amount of substance and of a number, or preferably all, of the substance tailings determined in the preceding dispensing steps during the closing of the valve. As a particular feature, the substance tailing values determined in the preceding dispensing steps during the closing of the valve are averaged to establish the final value for terminating the last dispensing step.

In another preferred embodiment of the invention, the filling of the first container is followed by the filling of another container in a single dispensing step, in which case the final value for terminating that single dispensing step in filling that additional container is established in consideration of the desired minimum substance amount and of a tailing value determined during the filling of the first container. In contrast to the prior art systems wherein an adequate number of tailing values cannot be obtained until several containers have been sequentially filled, it is possible in this case to obtain a sufficient number of tailing values already as soon as the first container has been filled, whereupon additional containers can be filled in one continuous dispensing cycle. The final value is established simply by applying a tailing value that was determined during the filling of the first container.

As a special feature in a preferred embodiment of the invention applying the above-described procedure, the final value for terminating the single dispensing step for filling the additional container is established by averaging the tailing values determined during the filling of the first container. Moreover, in a preferred version of the invention, the filling of the first container is followed by the individual filling of multiple additional containers, in which case the respective final value terminating each such filling is established in consideration of the minimum substance amount and of a tailing value determined in a preceding filling process. In particular, this may include an operation whereby, in the nth step, the final value $E_n$ is established as follows:

$$E_n = E_{n-1} - \sum_{i=n-x}^{n-1} \frac{Ni}{x}$$

where N is the tailing and x is the number of filling processes in which the tailing values are used for establishing the final value.

There are numerous ways in which the method according to this invention can be configured and expanded. In that context, attention is invited to the dependent claims and to the following detailed description of a preferred embodiment of the invention with reference to the accompanying drawings.

DETAILED DESCRIPTION OF A PREFERRED EMBODIMENT

Figure 1:
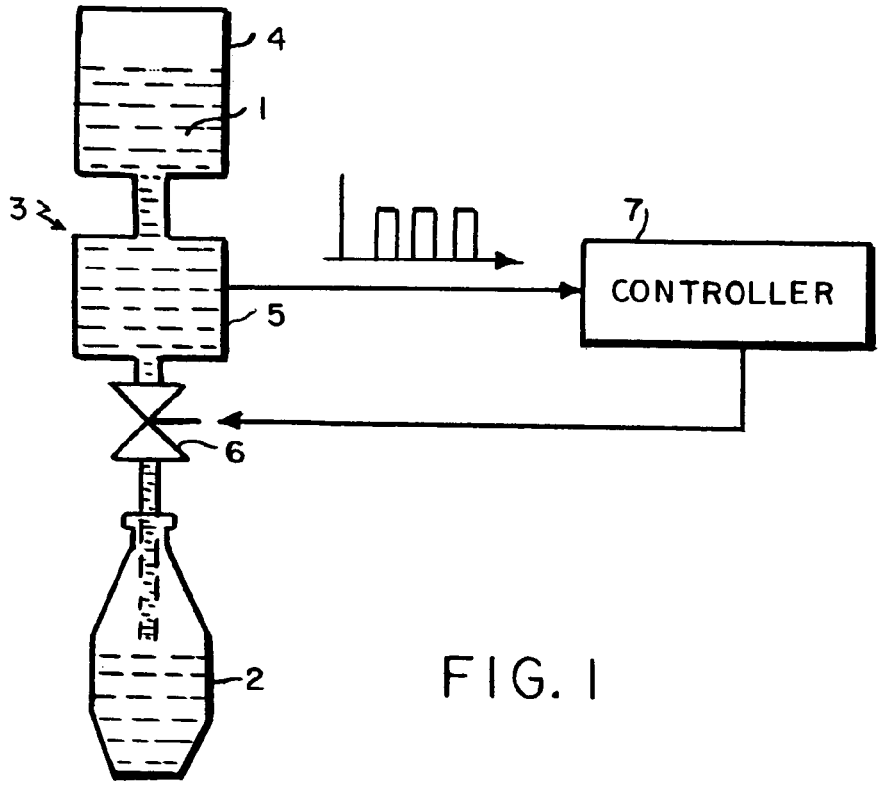
FIG. 1 is a schematic illustration of a bottling process according to a preferred embodiment of the invention, employing an appropriate dispensing system.

FIG. 1 illustrates schematically the dispensing of a substance 1 into a container 2 using a dispensing system 3. The substance 1 may be a liquid or a pourable bulk product. In the case shown, it is a beverage. The dispensing system 3 includes a reservoir 4, a flow-measuring device 5 and a valve 6. When the valve 6 is open, the substance 1 flows into the container 2.

The valve 6 is controlled, i.e. opened and closed, by a valve controller 7. The valve controller 7 is also connected to the flow-measuring device 5, which permits operation of the valve 6 as a function of the dispensed amount of substance 1 as detected by the flow-measuring device 5.

The flow-measuring device 5 may be in the form of a mass flowmeter or a volume flowmeter such as a magneto-inductive flowmeter or an ultrasound flowmeter. The flowmeter 5 signals the flow volume detected by it to the valve controller 7, in the case of the preferred embodiment of the invention here illustrated in FIG. 1 in the form of scaled pulses, specifically one pulse per predefined quantity unit detected. Alternatively, the information on the flow amount detected by the flowmeter 5 may be transmitted to the valve controller 7, for instance, in the form of a digital signal via a bus interface.

The valve controller 7 integrates the flow-volume data collected by and received from the flowmeter 5. The integrated flow data reflect at all times the amount of substance that has been dispensed from the reservoir 4 through the flowmeter 5 and the valve 6 into the container 2.

Figure 2:
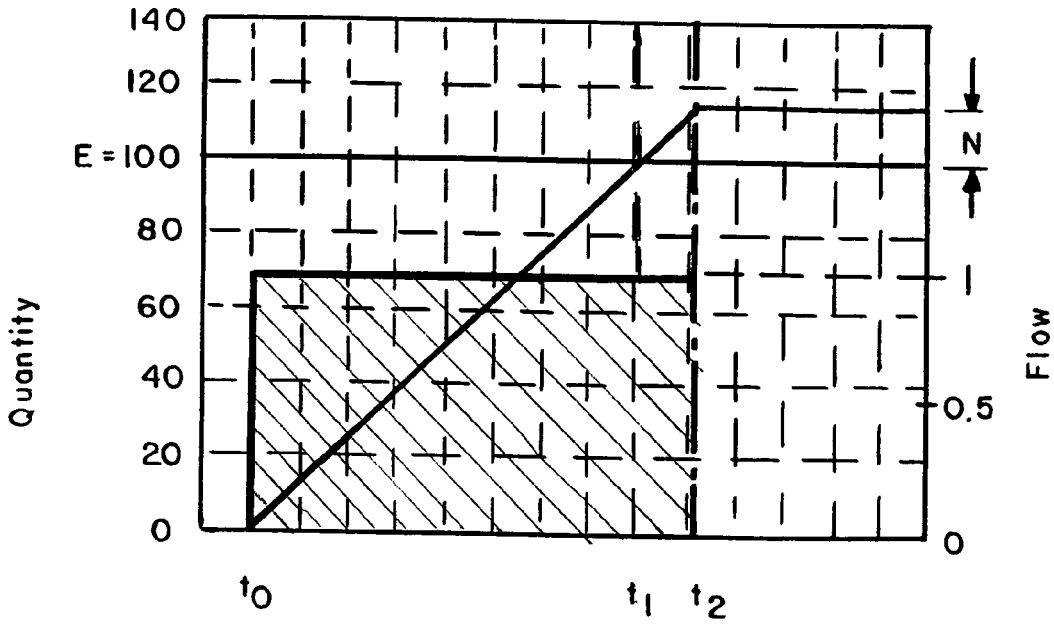
FIG. 2 PRIOR ART
FIG. 2 is a diagrammatic representation of the progression of a conventional filling process.

FIG. 2 is a diagrammatic illustration of the filling of the container 2 with the substance 1 by a conventional process, manifesting the tailing-related problem associated with the time it takes to ultimately close the valve 6. At point $t_0$ the valve controller 7 opens the valve 6. As indicated in FIG. 2, the flow rate, shown as the hatched area in the diagram, almost immediately rises to a constant level, here calibrated at a value of 1. Consequently, as time progresses, the amount of substance 1 dispensed into the container 2 will increase, as represented by the straight, linearly sloped line. At point in time $t_1$ the amount of substance 1 dispensed into the container 2 reaches the final value E of 100, which, due to the integration of the flow data for the dispensed amount of substance 1 by the flowmeter 5, prompts the valve controller 7 to close the valve 6. In the case at hand, the final value of 100 constitutes the targeted minimum amount, meaning that in this case the minimum amount of 100 is to be dispensed into the container 2, so that for the time being the filling process is not terminated before that value is reached.

By the time the valve 6 is closed, a finite time span will have elapsed from point $t_1$ forward, meaning that the flow will not stop until later, at point $t_2$. While the valve 6 proceeds to close, the flow remains nearly constant as illustrated in FIG. 2, the result being that the container 2 receives a quantity of substance 1 that exceeds, by the amount of the tailing N, the final value E of 100 at which the valve controller 7 was to close the valve 6.

Figure 3:
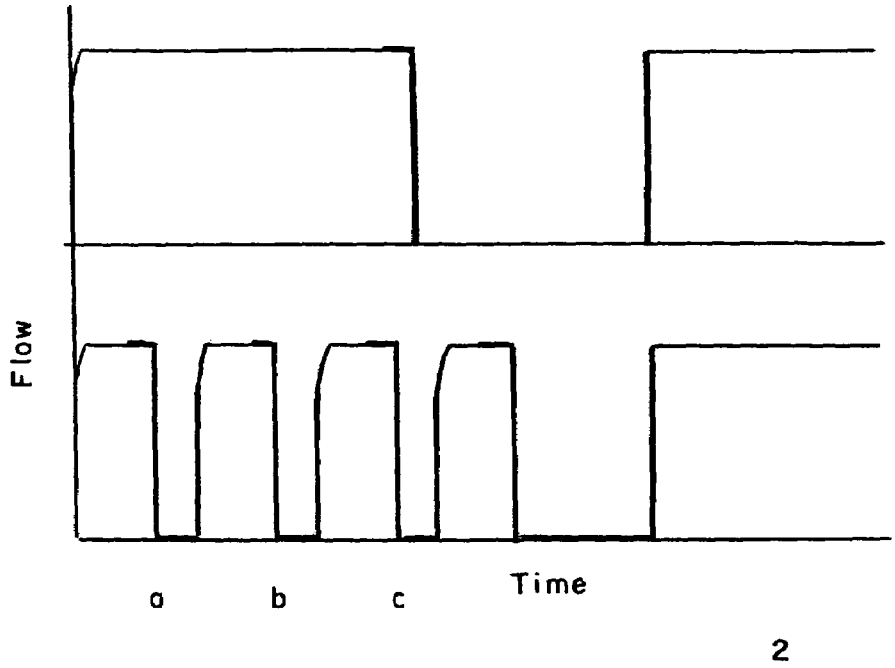
FIG. 3 is a diagrammatic representation of the progression of a process according to a preferred embodiment of the invention as compared to a conventional process.
Figure 4:
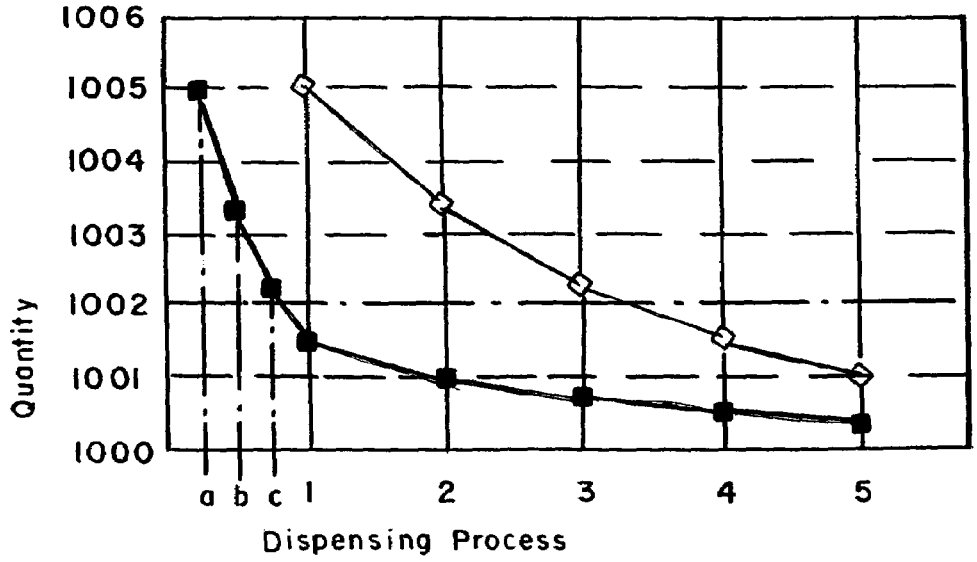
FIG. 4 is a plot of the dispensed quantities in the case of consecutive fillings with conventional and, respectively, novel compensation for tailing, according to a preferred embodiment of the invention.

In FIG. 3, the bottom waveform reflecting the method according to the preferred embodiment of the invention, shows that, in contrast to the conventional method represented by the top waveform, the flow is interrupted several times during the process of filling the container 2 with the substance 1 before the minimum amount of the substance to be dispensed into the container 2 is reached, in this case three times at points a, b and c. In the plot according to FIG. 4 reflecting the individually dispensed amounts in the first filling process, these interruptions that take place before termination of that first filling process have been extrapolated to a complete filling. At interruption point a, prompted by the valve controller 7 triggering the valve 6 at one fourth of the final value of 1000, i.e. at 250, the valve 6 had closed completely after a dispensed amount of 255. The tailing thus amounted to 5, so that, if the system were shut off at an end value of 1000, the actual amount would have been 1005.

Based on that information relative to the tailing delay of the valve 6 as demonstrated in the preferred embodiment of the invention illustrated, the valve 6 will be actuated that much earlier at interruption points b and c, below an extrapolated minimum value of 1000, so that, with an appropriate setting of the final value for terminating the last dispensing step, the valve 6 is triggered early enough to cause the amount of substance 1 that is actually dispensed into the container 2 to be above the required minimum value of 1000 and below 1002, and thus within the setpoint tolerance of 2. By additionally applying, for instance, the equation shown above for the final value E, it is actually possible in subsequent filling processes to further reduce the amount of substance 1 dispensed into the container 2, bringing it close to the desired minimum value of 1000.

It bears mentioning that, of course, with a fixed setpoint number of interruptions during the first filling process, it is possible for the amount of substance 1 dispensed into the container 2 in that first filling process to exceed the tolerance limit of 1002. In that case, the procedure described in the preferred embodiment of the invention can be further enhanced by means of interruptions in the second filling step as well, bringing the actual amount of substance 1 dispensed to within the tolerance range.

What is claimed is:

1. A method for dispensing a desired minimum amount of a liquid or pourable substance into a container to fill the container during a filling process, in the course of which the amount of dispensed substance is measured and the filling process is terminated by the closing of a valve as soon as the amount of dispensed substance has reached a final value, said method comprising the steps of dispensing the substance into a first container in a series of several dispensing steps where in a first dispensing step and at least one subsequent dispensing step, respectively, the valve is closed to interrupt the filling process so as to allow the determination of the tailing of the substance that occurs during the closing of the valve, and establishing the final value for terminating a last dispensing step in said series in consideration of the desired minimum amount of the substance and by factoring-in several of the tailings of the substance determined in the preceding dispensing steps during the closing of the valve.

2. The method as in claim 1, including the step of establishing the final value for terminating the last dispensing step in said series by averaging the tailings of the substance determined in the preceding dispensing steps in the series during the closing of the valve.

3. The method as in claim 1 or 2, including the step of, after the first container has been filled, filling another container in one single dispensing step, with the final value for terminating said one single dispensing step in filling said additional container being established in consideration of the desired minimum amount of the substance and by factoring-in a tailing value determined during the filling of the first container.

4. The method as in claim 3, including the step of averaging the tailing values determined during the filling of the first container thereby establishing the final value for terminating said one single dispensing step in filling said additional container.

5. The method as in claim 3, including the step of following the filling of the first container with a plurality of additional individual container fillings, in each case with the respective final value for terminating the filling process concerned being established in consideration of the desired minimum amount of the substance and by factoring-in a tailing value determined in a preceding filling process.

* * * * *